US006242095B1

(12) United States Patent
Juijn et al.

(10) Patent No.: US 6,242,095 B1
(45) Date of Patent: Jun. 5, 2001

(54) POLYESTER YARN WITH GOOD RUBBER ADHESION MADE OF CORE-SHEATH FIBERS WITH TWO DIFFERENT TYPES OF POLYESTERS

(75) Inventors: Johannes A. Juijn, Velp; Leonardus A.G. Busscher, Duvien, both of (NL)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 08/102,761

(22) Filed: Aug. 6, 1993

(30) Foreign Application Priority Data

Aug. 10, 1992 (DE) ..... 42 26 369

(51) Int. Cl.[7] ..... D02G 3/00
(52) U.S. Cl. ..... 428/374; 428/373; 428/395
(58) Field of Search ..... 428/375, 373, 428/374, 394, 395, 296, 364, 151; 57/12

(56) References Cited

U.S. PATENT DOCUMENTS 3,542,737 11/1970 Keck et al. .
3,595,731 * 7/1971 Davies et al. ..... 161/150
4,032,993 * 7/1977 Coquard et al. ..... 3/1
4,551,378 * 11/1985 Carey, Jr. ..... 428/198
4,789,592 * 12/1988 Taniguchi et al. ..... 428/373
5,009,951 * 4/1991 Ohmae et al. ..... 428/294
5,201,689 * 4/1993 Lijten et al. ..... 474/268
5,252,397 * 10/1993 Hanzawa et al. ..... 428/373

FOREIGN PATENT DOCUMENTS 0 201 114 12/1986 (EP) .
398221 11/1990 (EP) .
1344492 1/1974 (GB) .

* cited by examiner

*Primary Examiner*—Merrick Dixon
(74) *Attorney, Agent, or Firm*—Oliff & Berridge, PLC

(57) ABSTRACT

Core-sheath fibers are useful as textile reinforcing materials in rubber items having rubber adhesion of 180 to 260 N/2 cm. The fiber core is a high-melting (co)polyester and the sheath is a high-melting unsaturated copolyester. The high-melting unsaturated copolyester is made from at least one unsaturated dicarboxylic acid coconstituent, which contains at least 2 mole-%, based on dicarboxylic acid components, of alkylmaleic acid, having a 1 to 18 carbon atom alkyl group; alkylenesuccinic acid having a 1 to 18 carbon atom alkylene group; or their polyester-forming derivatives.

12 Claims, No Drawings

POLYESTER YARN WITH GOOD RUBBER ADHESION MADE OF CORE-SHEATH FIBERS WITH TWO DIFFERENT TYPES OF POLYESTERS

FIELD OF THE INVENTION

This invention relates to a polyester yarn with good rubber adhesion made of core-sheath fibers with two different types of polyesters and a process for making it.

BACKGROUND OF THE INVENTION

Most rubber items contain textile reinforcing materials as an integral constituent to provide for dimensional stability and to reduce the high elongation of the rubber. Good adhesion of the rubber to the textile material is an indispensable prerequisite for satisfactory function and lengthy life of rubber items that contain textile reinforcing materials, for example motor vehicle tires, V-belts, and conveyor belts. If the adhesion is inadequate, the bond between the elastomer and the fiber material is broken with time, which results in destruction of the textile reinforcement from chafing, or by melting in case of local overheating. Rubber adhesion presents difficulties, particularly with the polyester fibers present as yarn filament, since there are hardly any mechanical anchoring possibilities for the rubber because of their molecular structure, as is the case with cotton fiber yarns, so that special binders are necessary.

While impregnation with resorcinol-formaldehyde resins combined with latices (RFL dip), especially vinyl-pyridine latex, is already sufficient to improve the adhesion of nylon yarns to rubber, special additional measures are necessary for polyester yarns. For them to provide adequate rubber adhesion with a conventional nylon dip (or with adhesive mixtures), the so-called spin-finish types of polyester were developed. To make them, specific adhesion promoters are applied to the polyester fibers immediately after they are spun, simultaneously with the spinning preparation, to improve rubber adhesion; they consist of definite epoxy compounds and amine hardeners, and impregnation is carried out on the cord yarn with an aqueous dispersion of resorcinol-formaldehyde resins and vinylpyridine latex. The drawbacks to applying epoxy compounds and amines consist on the one hand of the contamination of machine parts, and also of the fact that the production rates of polyester yarns are impaired, and furthermore, substantial environmental problems occur.

To avoid the application of adhesion promoters, it is known how to produce two-component yarns whose core consists of polyethylene glycol terephthalate and whose sheath consists of a polyamide (cf., for example, EP 0 398 221 A1), since polyamides by nature show better rubber adhesion than polyesters. However, this presents the problem that the adhesion of the polyester core to the polyamide sheath is inadequate. For this reason, it is necessary to reduce the core/sheath ratio of the fibers for practical application as tire cords in a way that results in insufficient utilization of the good and desirable polyester properties.

A problem underlying this invention was to avoid the procedural step of applying the aforementioned adhesion promoters, and to make available new polyester yarns made of core-sheath fibers with good rubber adhesion, for which there is no longer inadequate adhesion between core and sheath even with very large core/sheath ratios of the fibers.

This problem is solved by the features of the invention.

SUMMARY OF THE INVENTION

Polyester yarns made of core-sheath fibers pursuant to the invention are characterized first by the fact that the core of the core-sheath fibers is comprised of a high-melting fiber-forming polyester. Fundamentally, all high-melting fiber-forming polyesters and copolyesters are suitable for this, such as polyethylene glycol terephthalate, poly(ethylene 2,6-naphthalenedicarboxylate), poly(1,4-dimethylenecyclohexane terephthalate) and their copolymers based on high proportions of homopolyester. In a preferred embodiment, the core of the core-sheath fibers consists at least substantially of polyethylene glycol terephthalate. This means particularly the homopolyester polyethylene glycol terephthalate and its copolyesters that contain at least 90 mole-% ethylene glycol terephthalate units. The remaining dicarboxylic acid and diol components of these copolyesters can be the usual coconstituents for producing extended polyester structures, for example isophthalic acid, p-hydroxybenzoic acid, p,p'-diphenyldicarboxylic acid, all possible naphthalenedicarboxylic acids, hexahydroterephthalic acid, adipic acid, sebacic acid, and glycols such as 1,4-dihydroxymethylcyclohexane, trimethylene glycol, tetramethylene glycol, hexamethylene glycol, and decamethylene glycol, etc.

The polyesters and copolyesters preferred for the core of the core-sheath fibers should have a viscosity as high as possible, i.e., a relative solution viscosity of at least 1.8, preferably from 1.9 to 2.3, measured at 25° C. as a 1 wt. % solution in m-cresol, and a melting point of at least 250° C. The desired high viscosities can be obtained using known procedures, for example condensation in the melt, additional post-condensation in the melt with or without condensation accelerator(s), or post-condensation in the solid state.

The polyester yarns made of core-sheath fibers pursuant to the invention are also characterized by the fact that the sheath of the core-sheath fibers is comprised of a high-melting unsaturated copolyester that has been made, based on the dicarboxylic acid components, with one or more unsaturated dicarboxylic acid coconstituent(s) comprising at least 2 mole-% alkylmaleic acid with an alkyl group having from 1 to 18 carbon atoms and/or alkylenesuccinic acid with an alkylene group having from 1 to 18 carbon atoms and/or their polyester-forming derivatives. In principle, all high-melting fiber-forming polyester and copolyester structures that are used for the core of the core-sheath fibers are suitable for the polyester modification with the unsaturated dicarboxylic acid components, but especially those that contain at least 90 mole-% ethylene glycol terephthalate units. Citraconic acid and itaconic acid and their polyester-forming derivatives are preferred as unsaturated dicarboxylic acid components; they are used in amounts of at least 2 mole-% based on the dicarboxylic acid components.

DETAILED DESCRIPTION OF PREFERRED EMBODIMENTS

In a particularly preferred embodiment, the sheath of the core-sheath fibers may consist of an unsaturated copolyester that contains 95 to 98 mole-% ethylene glycol. terephthalate units and has been made with 2 to 5 mole-%, preferably with 3 to 4 mole-% citraconic acid and/or itaconic acid and/or their polyester-forming derivatives, Ethylene glycol is preferably used alone as the glycol component of such unsaturated copolyesters. Especially preferred polyester-forming derivatives of citraconic acid and itaconic acid are citraconic anhydride, dimethyl citraconate, and dimethyl itaconate.

To avoid crosslinking, it may be advantageous when preparing the unsaturated copolyesters to carry out the transesterification and/or polycondensation in the presence of antioxidants. Especially suitable for this are sterically hindered phenols such as di-n-octadecyl (5-t-butyl-4-hydroxy-3-methylbenzyl)malonate (Irganox 420), octadecyl 3-(3,5-di-t-butyl-4-hydroxyphenyl)propionate (Irganox 1076), 1,1-bis(5-t-butyl-4-hydroxy-2-methylphenyl)butane (Irganox 414), tetrakis[methylene(3,5-di-t-butyl-4-hydroxyhydrocinnamate)]methane (Irganox 1010), N,N'-1,6-hexamethylenebis-3-(3,5-di-t-butyl-4-hydroxyphenyl) propionamide (Irganox 1098), 1,3,5-tri(3,5-di-t-butyl-4-hydroxybenzyl)-2,4,6-trimethylbenzene (Irganox 1330), and tris(2,6-dimethyl-3-hydroxy-4-t-butylbenzyl)-s-triazine-2,4,6(1H,3H,5H)trione (Cyanox 1790).

The above unsaturated dicarboxylic acid components can be cocondensed with the mentioned antioxidants with no problematical increase of viscosity, even in rather large quantities, for example 8 mole-%. In general, however, for polyesters that contain at least 90 mole-% ethylene glycol terephthalate units, 5 mole-% of the unsaturated dicarboxylic acid components based on the total of all dicarboxylic acid components is sufficient. With larger quantities of unsaturated dicarboxylic acids, a disadvantageous drop of melting point to below 245° C. would occur with this type of copolyester.

Unsaturated copolyesters that contain 96 mole-%, for example, of ethylene glycol terephthalate units and 4, mole-% of ethylene glycol citraconate units or 4 mole-%; ethylene glycol itaconate units, show melting points of 248.9 and 246.8° C., respectively, so that the necessary dipping of cord yarns can be carried out at 240° C. without any temperature change and with no problems. The important glass transition temperatures $T_g$ are 79° C. and 76° C., respectively; therefore, they only insignificantly differ from the glass transition temperature of the polyethylene glycol terephthalate homopolyester, which is 80° C. This is particularly beneficial for the stretchability of the two-component yarn. The appropriate modifying quantities of alkylmaleic and/or alkylenesuccinic acids for other unsaturated types of copolyester that are not made up essentially based on ethylene glycol terephthalate units can be determined readily by determining their melting points and glass transition temperatures.

The copolyesters preferred for the sheath of the core-sheath fibers in general may have a relative solution viscosity of at least 1.5, preferably from 1.6 to 2.0, measured at 25° C. as a 1 wt. % solution in m-cresol, and a melting point of at least 245° C.

To produce core-sheath ratios at uniform levels, the yarns made of core-sheath fibers pursuant to the invention are preferably prepared by the procedure described in EP 0 398 221 A1. In this procedure, the extruded core component is fed through a first spinneret plate to a second spinneret plate in several separate streams, the extruded sheath component being fed in to flow around each separate core component stream between the first and second spinneret plates. The two components are spun, stretched, and wound up jointly, and the sheath component is exposed to flow resistance at least around the area of the separate streams of core component. A wire mesh netting is particularly suitable as flow resistance. Even though the weight ratio of the different core/sheath polymers may be varied within extremely wide limits, the core polymer is preferably melt-spun with the sheath polymer in a weight ratio of 95:5 to 80:20.

The core-sheath polymer combinations pursuant to the invention can be spun at the same speeds as the core-sheath fibers made up of polyethylene glycol terephthalate and Polyamide 66 from EP 0 398 221 A1 intended for tire cords, for example at a speed of 500 m/min or 900 m/min In the case of the latter spinning speed, the polyester yarn is then stretched in a first stretching step to the extent of about 1:3, and in a second stretching step to a total stretch ratio of about 1:5, while the total stretch ratio in the case of the spinning speed mentioned first is about 1:6.

Surprisingly, the core-sheath combinations pursuant to the invention can also be fast-spun at the spinning speeds of 3000–5000 m/min, speeds customary in the fast-spinning of polyester single-component yarns. The polyester yarns thus obtained are then stretched in a first stretching step to about 1:1.8 to 1:1.2, and in a second stretching step to a total stretching ratio of about 1:2.4 to 1:1.6.

Although the tensile strength and elongation at break of the yarns can naturally be varied considerably depending on the degree of stretching chosen, the polyester yarns thus obtained generally have a tensile strength of 600 to 850 mN/tex, an elongation at break of 10 to 14%, and rubber adhesion of 180 to 260 N/2 cm. With compliance with the customary physical data of polyester yarns intended for tire cords, these surprisingly high figures for rubber adhesion permit dispensing with the previous use of the specific adhesion promoters described above.

The invention will be described in detail with reference to the following examples.

EXAMPLE 1

A. In preparing unsaturated copolyesters, 48 kg of dimethyl terephthalate, 40 kg of ethylene glycol, and 16.3 g of $Mn(CH_3COO)_2.4\ H_2O$ are placed in a stirred 270-liter steel reactor equipped with a stirrer. When the dimethyl esters of alkylmaleic acid(s) and/or of alkylenesuccinic acid(s) are used as modifying comonomers, they are added to the transesterification mixture, for example 1.58 kg of dimethyl citraconate or dimethyl itaconate=4 mole-%. The transesterification is carried out with temperature increasing gradually to 245–250° C. in about 2 hours and 15 minutes.

After transesterification of the components is complete, 17.3 g of carbethoxymethyl diethylphosphonate and 12 g of $Sb_2O_3$ are added. When alkylmaleic acid(s) and/or alkylenesuccinic acid(s) or their anhydrides are used as modifying comonomers, they are also added at this time, for example 1.30 kg of citraconic acid or itaconic acid=4 mole-%, or 1.11 kg of citraconic anhydride=4 mole-%. This mixture is then transferred to a 150-liter autoclave equipped with a stirrer. The temperature is raised to about 280° C. and the pressure is reduced stepwise to 1 mbar or lower. The polycondensation is terminated upon reaching a relative viscosity of about 1.6, measured at 25° C., as a 1 wt. % solution in m-cresol. Depending on the temperature and vacuum program and the quantity of modifying comonomers, the time for polycondensation varies between 2 and 3 hours.

0.5 wt. % Irganox 1330 is added to the reactants in each case as antioxidant at the same time as the modifying unsaturated comonomers are added.

B. In preparing polyester yarns from core-sheath fibers, ten different yarns are sample spun with a core-sheath ratio of 90:10 parts by weight. Their core always consists of a polyethylene glycol terephthalate with, a relative viscosity of 2.04, always measured at 25° C. as a 1 wt. % solution in m-cresol. The sheath polymer consisted of the prepared copolyesters corresponding to each sample listed in the table, whose relative viscosity is about 1.6.

One extruder each is used as the melting and transport mechanism for the core-sheath polymer. The five temperatures of the extruder for the polyethylene glycol terephthalate as the core polymer in the transport direction are between 310° C. and 297° C. An adjustable pump provides a throughput of about 100 g/min when spinning is done at a spinning speed of 900 m/min. The throughput for the core polymer is about 126 g/min for a spinning speed of 4000 m/min.

The five zone temperatures of the extruder for the particular copolymer as sheath polymer in the transport direction are between 302° C. and 281° C. An adjustable pump provides for a throughput of about 11 g/min when spinning at a speed of 900 m/min. The throughput for the sheath polymer is 14 g/min for a spinning speed of 4000 m/min.

The core-sheath polymers are spun by the procedure described in EP 0 398 221 A1. A stainless steel 60 mesh screen net is used to provide flow resistance. The spinning plate contains 36 spinning holes with a diameter of 500 $\mu$m; the temperature of the spinning unit is kept at 297° C. A heating channel 40 cm long and with a wall temperature of 310° C. is mounted directly below the spinning plate.

The spun two-component yarns are solidified with a lateral stream of air at a temperature of 20° C. and with a velocity of 30 cm/min. About 1 wt. % of a conventional standard preparation is then applied to the polyester yarn; it contains no adhesion promoter such as epoxy compounds, isocyanate compounds, or the like, and the yarn is wound up at a speed of 900 m/min or 4000 m/min.

C. Five spun spools of as-spun yarns are combined and stretched on a steamdrawing frame. The yarns to be stretched contain 180 filaments. The first stretching is done on heated stretching pins at a temperature of 80° C. The stretching ratio of the yarns spun at 900 m/min or at 4000 m/min in the given order is varied slightly so that the main stretching point is located on the fifth stretching pin. The second stretching is carried out in a steam chamber with a steam temperature of 245° C., with the dwell time of the yarn in the steam chamber being 3 seconds. In all cases the total stretch ratio of the yarns spun at 900 m/min or at 4000 m/min is 1:5 and 1:1.8, respectively. The table below shows the yarn properties.

D. To measure the rubber adhesion, the yarns obtained are then each twisted into a tire cord of the construction 1100 dtex X1Z435X2S435. This cord is treated by a known method with an aqueous dispersion based on resorcinol-formaldehyde precondensate and vinylpyridine-styrene-butadiene latex (RFL), with 5 wt. % of solids content being applied to the cord. It is then a) dried for 120 seconds at 150° C. under tension of 20 mN/tex, b) hardened for 30 seconds at 240° C. under tension of 100 mN/tex, and c) hardened and relaxed for 30 seconds at 240° C. under tension of 20 mN/tex.

The dipped cords are covulcanized in a rubber blend in the form of strips according to ASTM D 4393-85 and the rubber adhesion is measured in N/2 cm, as the force to separate the strips 2 cm wide. The results are given in the table as the averages of six measurements each.

COMPARATIVE EXAMPLE

As a comparative example, core-sheath fibers consisting of polyethylene glycol terephthalate are made in the same way at a speed of 900 m/min; their core and sheath consist of the same homopolymer with a relative viscosity of 2.04.

TABLE

| Yarn Sample No. | Unsaturated dicarboxylic acid component | Mole-% | Spinning speed in m/min | Yarn count in dtex | Tensile strength in mN/tex | Elongation at break in % | Rubber adhesion in N/2 cm |
|---|---|---|---|---|---|---|---|
| 1 (not pursuant to invention) | Citraconic acid | 1 | 900 | 1242 | 740 | 9.9 | 125 |
| 2 | Citraconic acid | 2 | 900 | 1238 | 767 | 11.1 | 190 |
| 3 | Citraconic acid | 3 | 900 | 1247 | 820 | 10.0 | 255 |
| 4 | Citraconic anhydride | 4 | 900 | 1246 | 757 | 10.8 | 250 |
| 5 | Citraconic acid | 4 | 900 | 1245 | 755 | 11.1 | 250 |
| 6 | Citraconic acid | 4 | 4000 | 987 | 605 | 12.5 | 220 |
| 7 | Citraconic anhydride | 4 | 4000 | 997 | 613 | 14.0 | 225 |
| 8 | Dimethyl itaconate | 3 | 900 | 1245 | 780 | 10.5 | 245 |
| 9 | Itaconic acid | 4 | 900 | 1573 | 653 | 12.1 | 250 |
| 10 | Itaconic acid | 4 | 4000 | 1004 | 681 | 10.9 | 230 |
| Comparative Example | None Core = Sheath = PET | 0 | 900 | 1190 | 755 | 11.1 | 75 |

What is claimed is:

1. A polyester yarn having good rubber adhesion comprising core-sheath fibers, said core-sheath fibers comprising two different types of polyesters, wherein:

a) a core of the core-sheath fibers comprises high-melting polyester or copolyester, and b) a sheath of the core-sheath fibers; comprises a high-melting, unsaturated copolyester having been prepared from at least one unsaturated dicarboxylic acid coconstituent, said coconstituent comprising at least about 2 mole-%, based on the dicarboxylic acid constituents, of at least one member selected from the group consisting of alkylmaleic acid having a 1 to 18 carbon atom alkyl group; alkylenesuccinic acid having a 1 to 18 carbon atom alkylene group; and their polyester-forming derivatives.

2. The polyester yarn of claim 1, wherein the core is polyethylene glycol terephthalate.

3. The polyester yarn of claim 1, wherein the sheath comprises an unsaturated copolyester comprising at least about 90 mole-% ethylene glycol terephthalate units, and being produced with at least one unsaturated dicarboxylic acid coconstituent, said coconstituent comprising at least about 2 mole-% of at least one member selected from the group consisting of citraconic acid; itaconic acid; and their polyester-forming derivatives.

4. The polyester yarn of claim 1, wherein the sheath comprises an unsaturated copolyester comprising about 95 to about 98 mole-% ethylene glycol terephthalate units, produced with about 2 to about 5 mole-% of at least one member selected from the group consisting of citraconic acid; itaconic acid; and their polyester-forming derivatives.

5. The polyester yarn of claim 1, wherein the dicarboxylic acid coconstituent comprises from about 3 to about 4 mole-%, based on the dicarboxylic acid constituents, of at least one member of the group consisting of alkylmaleic acid having a 1 to 18 carbon atom alkyl group; alkylenesuccinic acid having a 1 to 18 carbon atom alkylene group; and their polyester-forming derivatives.

6. The polyester yarn of claim 1, wherein the core is polyethylene glycol terephthalate and has a relative solution viscosity of at least about 1.8, measured at 25° C. as a 1 wt. % solution in m-cresol, and a melting point of at least 250° C.

7. The polyester yarn of claim 6, wherein the solution viscosity ranges from about 1.9 to about 2.3.

8. The polyester yarn of claim 1, wherein the unsaturated copolyester in the sheath of the core-sheath fibers has a relative solution viscosity of at least 1.5, measured at 25° C. as a 1 wt. % solution in m-cresol, and a melting point of at least 245° C.

9. The polyester yarn of claim 8, wherein the solution viscosity ranges from about 1.6 to about 2.0.

10. The polyester yarn of claim 1, wherein a core-sheath ratio by weight of the fibers ranges from about 95:5 to about 80:20.

11. The polyester yarn of claim 1, wherein the yarn has a tensile strength of 600 to 850 mN/tex, an elongation at break ranging from about 10% to about 14%, and a rubber adhesion of 180 to 260 N/2 cm.

12. The polyester yarn of claim 1, wherein the polyester-forming derivatives are selected from the group consisting of citraconic anhydride, dimethyl citraconate, and dimethyl itaconate.

* * * * *

UNITED STATES PATENT AND TRADEMARK OFFICE

CERTIFICATE OF CORRECTION

PATENT NO. : 6,242,095 B1 
DATED : June 5, 2001
INVENTOR(S) : Johannes A. Juijn and Leonardus A.G. Busscher It is certified that error appears in the above-identified patent and that said Letters Patent is hereby corrected as shown below:

Title page,
Item [56], References Cited, U.S. PATENT DOCUMENTS, change "7/1971" to -- 8/1971 --; and change "7/1977" to -- 8/1977 --.

Column 2,
Line 56, delete the period after "glycol".
Line 59, change the "," after "derivatives" to a -- . --.

Column 3,
Line 24, delete "," after "4".
Line 25, delete ";" after "%".
Line 67, insert a -- . -- after "m/min".

Column 4,
Line 59, delete the "," after "with".

Column 6,
Line 41, delete the ";" after "fibers".
Line 46, change "constituents" to -- coconstituents --.

Column 7,
Line 1, change "constituents" to -- coconstituents --.

Signed and Sealed this

Twentieth Day of August, 2002

*Attest:*

*Attesting Officer*

JAMES E. ROGAN
*Director of the United States Patent and Trademark Office*